United States Patent [19]

Mortoly

[11] 4,068,834

[45] Jan. 17, 1978

[54] CLAMP WITH ROCKABLE JAW FACE PLATE

[75] Inventor: John L. Mortoly, Poughkeepsie, N.Y.

[73] Assignee: James L. Taylor Manufacturing Company, Poughkeepsie, N.Y.

[21] Appl. No.: 647,041

[22] Filed: Jan. 7, 1976

[51] Int. Cl.[2] ..... B25B 1/22

[52] U.S. Cl. ..... 269/264

[58] Field of Search ..... 269/258–264

[56] References Cited

U.S. PATENT DOCUMENTS

| | | | |
|---|---|---|---|
| 228,245 | 6/1880 | Brady | 269/263 |
| 508,732 | 11/1893 | Mason | 269/264 |
| 3,685,817 | 8/1972 | Worthington | 269/263 |

*Primary Examiner*—Robert C. Watson

*Attorney, Agent, or Firm*—Edward R. Weingram

[57] ABSTRACT

A jaw for use in a clamp in which there are two relatively movable jaws on a frame to clamp board stock between them, said jaw including a body and a face plate having a rib abutting the face of said body as a horizontal fulcrum for rocking of the face plate, and a spring device engaging both said body and the rear side of said face plate on at least one side of said rib and constituting a resilient mounting of said face plate on said jaw body providing for even distribution of the clamping force to the upper and lower portions of the boards, one form of the resilient mounting means including two brackets held on the jaw body by a tension spring connecting the brackets and extending in a groove across the front side of the face plate, each bracket having resilient arms engaging the back of the face plate at opposite sides of said fulcrum.

7 Claims, 7 Drawing Figures

CLAMP WITH ROCKABLE JAW FACE PLATE

BACKGROUND OF THE INVENTION

This invention relates in general to bar clamps that comprise a frame having parallel rigid rails on which are mounted a fixed jaw and a screw-actuated movable jaw slidable on said rails to clamp between the jaws pieces of stock to be glued together for use, for example, in clamp carriers such as shown in U.S. Pat. Nos. 1,653,035, 1,702,036 and 3,488,046.

For clamping so-called thick stock for example while gluing together or laminating into panels boards that are six inches wide and stand six inches high on the rails, the jaw of each clamp includes a rigid cast iron body mounted on the rails and having a face plate rockable thereon about a horizontal axis between its upper and lower edges to engage the stock and pivot or rock about said axis so as to distribute the clamping pressure practically evenly to the upper and lower edge portions of the board stock. Heretofore a single spring wire has served as said axis and has curved portions separably held by inherent resiliency in notches in the ends of the face plate and in notches in the end surfaces of the jaw body. This construction is not entirely satisfactory because especially when the clamp is not in use, the spring wire sometimes accidentally falls or is knocked out of said notches and the face plate is allowed to drop off the clamp body and thereby cause aggravation of the operator and loss of time in remounting the face plate on the clamp body.

SUMMARY OF THE INVENTION

One object of the invention is to overcome the disadvantages of and objections to these prior devices and to provide means including a novel and improved construction and combination of the jaw, face plate and a spring for mounting the face plate or rocker on the jaw body and normally yieldingly holding the face plate perpendicular to the rail surface on which the stock is set.

Another object is to provide such a construction wherein a helical tension spring serves as the horizontal axis of rocking of the face plate, and has its ends connected to mounting plates and portions of the mounting plates are selectively and separably engageable with notches spaced apart vertically of the end edges of the jaw body for vertical adjustment of the face plate on the jaw body to center the face plate on the stock whereby the mounting plates are firmly but separably held on the jaw body by said spring and the face plate is firmly held in operative position on the jaw body against unintentional separation from the body. The invention also eliminates the necessity for the slots in the end edges of the face plate.

Each mounting plate also has a spring arm at each side of the axis of said helical spring to yieldingly engage the rear side of the face plate, thereby to normally bias the face plate into a position perpendicular to the plane the stock bearing surfaces of said rails on the clamp frame or parallel to the face of the jaw body.

Other objects, advantages and results of the invention will appear from the following description in conjunction with the accompanying drawings in which:

FIG. 6 is a side elevational view of a modification of the invention, showing another form of means for mounting a face plate on a jaw body.

DESCRIPTION OF THE PREFERRED EMBODIMENT

Figure 1:
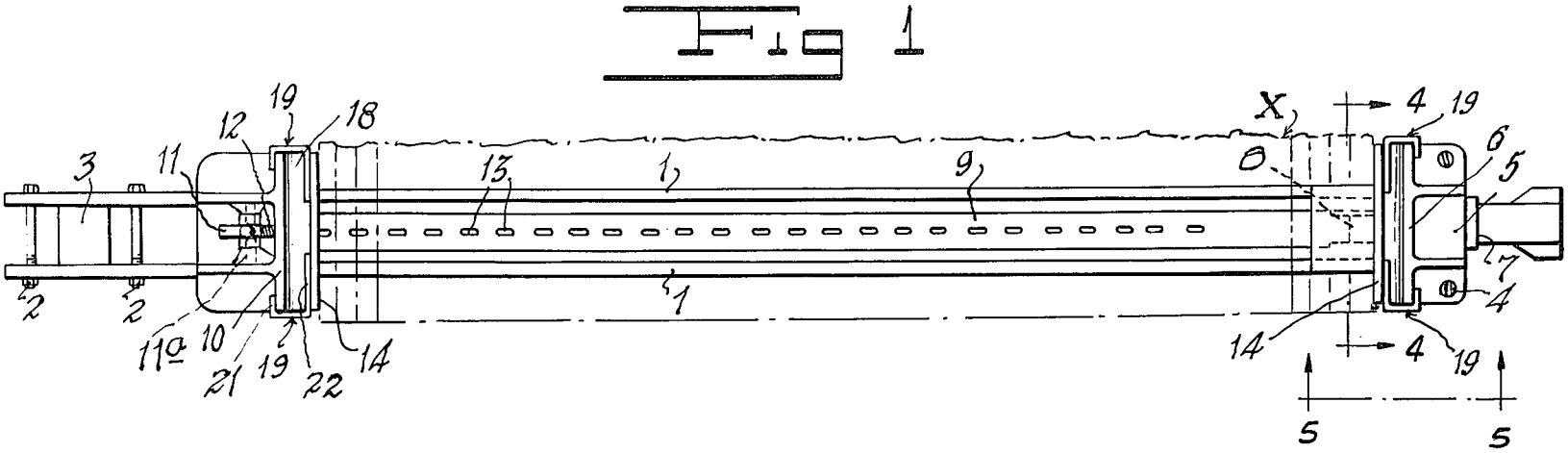
FIG. 1 is a top plan view of a bar clamp having jaw face plates or rockers constructed in accordance with the invention.

For the purpose of explanation the invention is being disclosed as embodied in a type of clamp shown in Taylor U.S. Pat. No. 1,529,281.

Now referring to FIGS. 1 to 5 of the present application, the clamp comprises a frame that has two spaced parallel rails 1 rigidly secured together at one end by bolts 2 and a spacer block 3 which may be formed for connection to the cross rods of a clamp carrier such as shown in Taylor U.S. Pat. No. 1,320,808 or to any other suitable support. At their other ends the rails are rigidly connected as by bolt 4 to a head 5 which provides a fixed clamp jaw 6. This head also carries a known type of screw mechanism 7 such as shown in U.S. Pat. No. 3,488,046 which is connected at 8 to a draw bar 9 for a movable jaw 10 slidably mounted on the rails 1 to move toward and away from the fixed jaw for clamping the stock to be glued between the jaws. This movable jaw is adjustably connected to the draw bar by a latch 11 pivotally mounted between its ends on the movable jaw and having a free end normally biased by a spring 12 into any one of a plurality of holes 13 spaced longitudinally of the draw bar.

Figure 2:
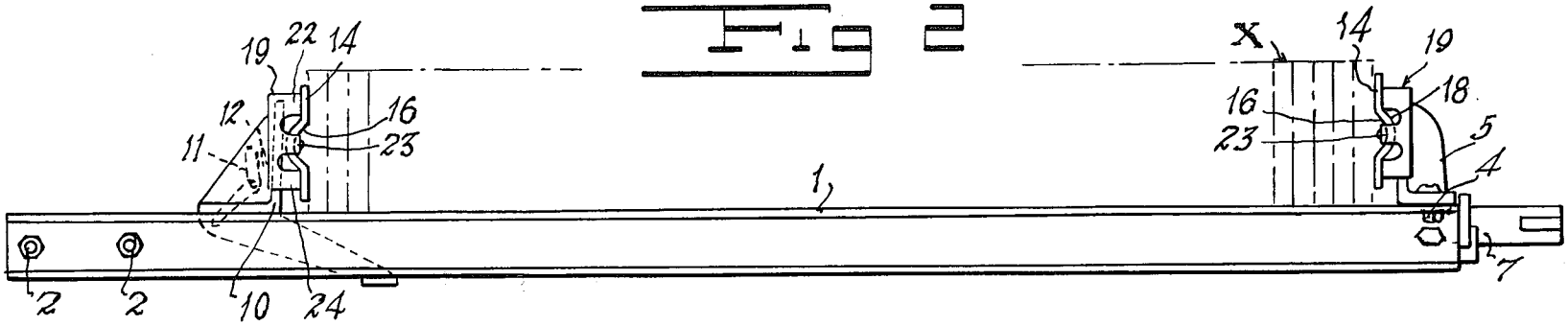
FIG. 2 is a side elevational view of the clamp.
Figures 3, 5, 7:
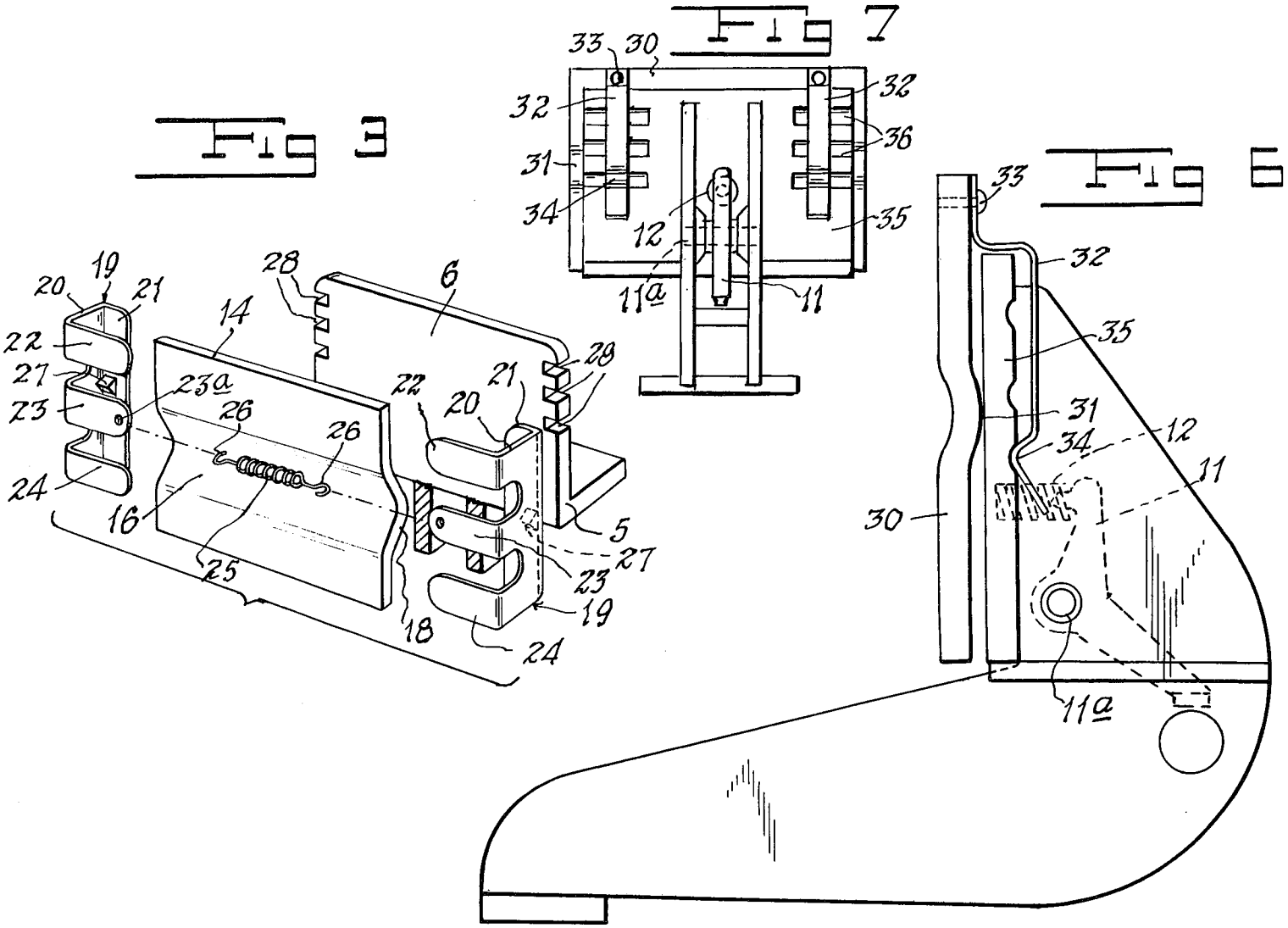
FIG. 3 is an exploded perspective view of a jaw body and the corresponding face plate mounting of one form of the invention.
FIG. 5 is a fragmentary side elevational view taken from the plane of line 5—5 of FIG. 4, with portions of the clamp frame rails broken away.
FIG. 7 is a rear elevational view on a reduced scale of the jaw shown in FIG. 6.
Figure 5:
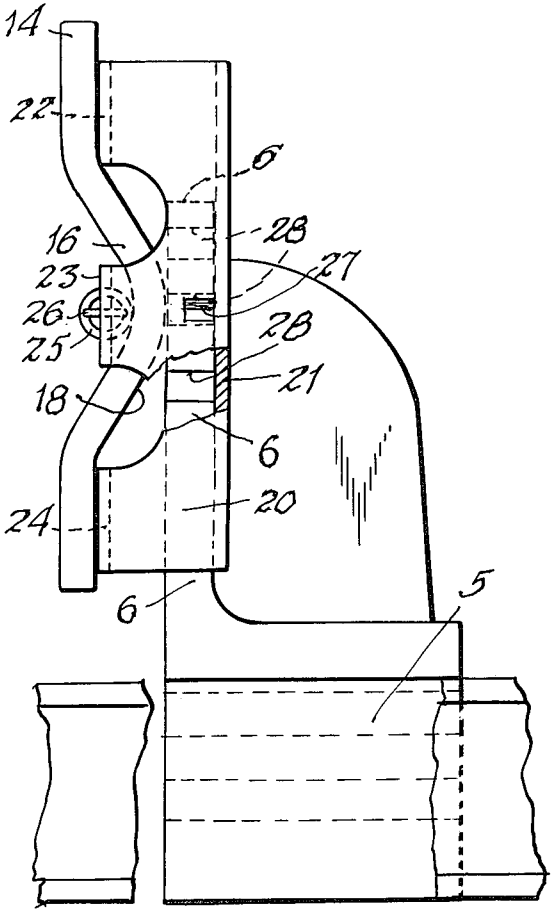
Figure 4:
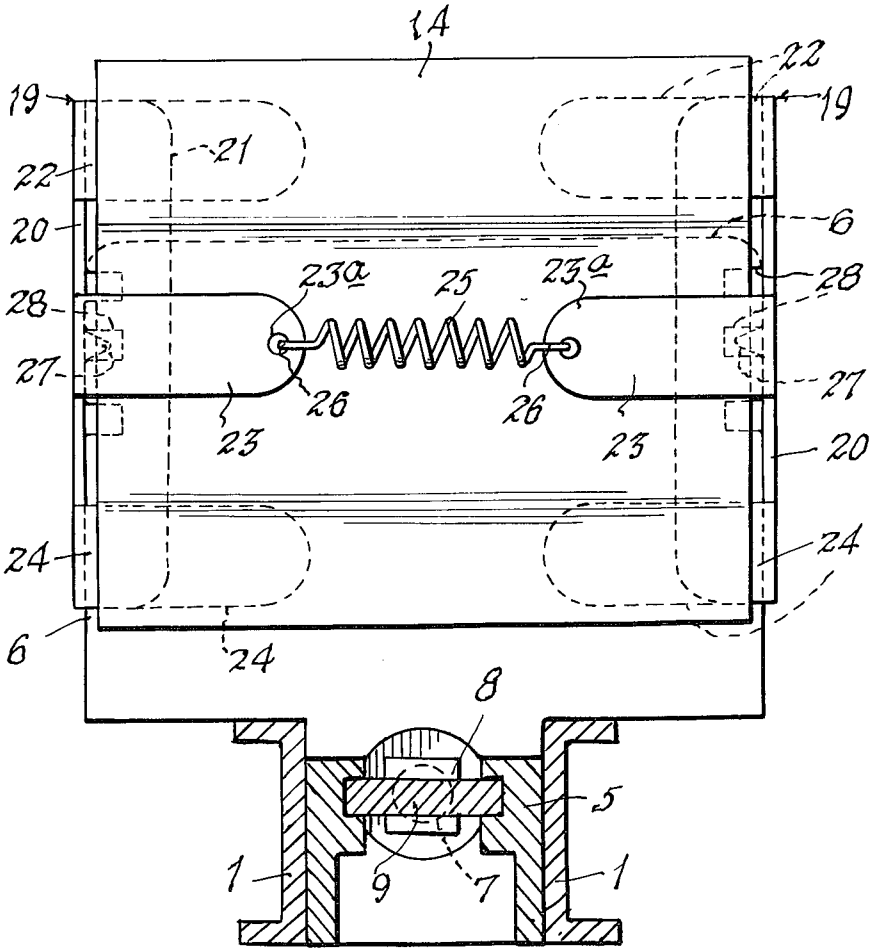
FIG. 4 is an enlarged front elevational view of the assembled jaw and face plate taken from the plane of the line 4—4 of FIG. 1, also showing the clamp frame in cross-section.

In accordance with known practice, a face plate or so-called rocker 14 is pivotally mounted on a horizontal axis on each jaw so as to distribute the clamping pressure practically evenly to the upper and lower edge portions of the board stock to be clamped which is fragmentarily and schematically illustrated by broken lines X on FIGS. 1 and 2.

The present invention provides a novel and improved mounting of the face plates on the faces of the two jaws. One form of mounting is shown in FIGS. 1 to 5 and may be substantially the same for both jaws. Here the face plate 14 has its central longitudinal portion offset from the general plane of the plate to provide in effect a longitudinal groove 16 with curved sides at the front or face side of the plate and a corresponding longitudinal curved rib 18 on the rear side of the plate to abut the face of the jaw and serve as a fulcrum for the rocking action of the plate. There are two identical mounting brackets 19 each to be separably mounted on one end of the corresponding jaw. Each bracket may be formed of sheet metal with limited inherent resiliency and has an elongated body portion 20 provided along one edge with a perpendicular flange 21 and along its other edge with three perpendicular arms 22, 23 and 24 spaced from the flange 21 and preferably equidistantly spaced from each other.

For mounting the face plate and the brackets on the jaw each bracket is applied to one end of the jaw with the body abutting the end of the jaw and with the flange 21 abutting the rear side of the jaw. The intermediate arm 23 of the bracket is thus spaced from the face plate in alinement with the groove 16, while the upper and lower arms 22 and 23 abut the rear side of the upper and lower portions of the face plate, said arms being in a common vertical plane and having inherent resiliency. A helically coiled tension spring 25 connects the intermediate arms 23 of the brackets, the ends of the spring having hooks 26 separably inserted into holes 27 in the arms 23. This spring pulls the bodies of the brackets into tight contact with the corresponding ends of the jaw and its coil is seated in the groove 16 of the face plate to hold the face plate in position on the jaw. To hold the brackets against unintended vertical movement on the jaw, each flange 21 has a lug or protuberance 27 selectively engageable with any of a plurality of notches 28 in the end surface of the jaw. The lug 27 and notches 28 permit vertical adjustment of the bracket and face plate to accomodate different heights of stock in addition to holding the face plate against vertical movement out of adjusted position.

The upper and lower arms being disposed in a common plane and having inherent resiliency, hold the face plate with its face normally parallel to the face of the jaw, but the arms may yield to permit the necessary rocking of the face plate as the jaws close upon the stock.

Another form of mounting of the face plate on the jaw is shown in FIG. 6 where the face plate 30 has a curved rib 31 on its rear face to abut the front face of the jaw 35 and serve as a fulcrum for the face plate. The face plate is mounted on the jaw by a pair of leaf springs 32 each having one end secured at 33 to the rear side of the face plate and having at its other end portion a crimp 34 to seat selectively in any of a plurality of grooves 36 in the rear surface of the jaw. With this construction, the springs normally hold the face plate parallel with the jaw face but will yield to permit rocking of the face plate for proper clamping engagement of the face plate with the stock to be clamped.

I claim:

1. A clamp jaw for use in a clamp wherein there are two relatively movable jaws on a frame and means to cause relative movement of said jaws to clamp and release stock between the jaws, said jaw comprising a body having a face, and a face plate rockable on said body on a horizontal axis, said face plate having on the rear side a curved fulcrum rib intermediate its upper and lower edges abutting said face of the jaw and providing said axis, means for mounting said face plate on said jaw comprising a spring device including parts engaging both said body of the jaw and the front of said face plate and the rear side of said face plate on at least one side of said rib means holding said face plate on the jaw body, and means providing resilient rocking action of said face plate on said axis.

2. A clamp jaw for use in a clamp wherein there are two relatively movable jaws on a frame and means to cause relative movement of said jaws to clamp and release stock between the jaws, said jaw including a body having a face, and a face plate rockable on said body on a horizontal axis, said face plate having on the rear side a curved fulcrum rib intermediate its upper and lower edges abutting said face of the jaw and providing said axis, means for mounting said face plate on said jaw comprising a spring device including parts engaging both said body of the jaw and the rear side of said face plate on at least one side of said rib and holding said face plate on the jaw body, and providing resilient rocking action of said face plate on said axis, and wherein said face plate has a groove in its front side opposite said rib and said means for mounting said face plate includes a bracket held on each end of the jaw body by a tension spring connecting said brackets and extending in said groove across the front side of the face plate, each bracket including resilient portions abutting the rear side of the face plate at opposite sides of said rib.

3. A clamp jaw as defined in claim 2 wherein each bracket has a body with a perpendicular flange along one edge abutting the rear of said jaw body, and two resilient arms extending from and spaced longitudinally of said body in angular relation to said bracket body and abutting the rear side of said face plate at opposite sides of said rib.

4. A clamp jaw as defined in claim 3 wherein each said bracket body has a third arm parallel to and located between said two arms, and said tension spring has one end connected to said third arm of each bracket.

5. A clamp as defined in claim 3 wherein said jaw body and each bracket have coactive portions separably holding said brackets against vertical movement on said jaw body.

6. A clamp jaw as defined in claim 5 wherein said coactive portions are respectively at least one notch on the jaw body and a lug on said flange of the bracket.

7. A clamp jaw as defined in claim 3 wherein the rear side of said jaw body has vertically spaced notches, and said flange of said bracket has a projection to seat selectively in any one of said notches to limit vertical movement of the bracket on said jaw body.

* * * * *